US007488000B2

(12) United States Patent
Kom

(10) Patent No.: US 7,488,000 B2
(45) Date of Patent: Feb. 10, 2009

(54) ADJUSTABLE BOOK COVER AND METHOD OF MAKING AN ADJUSTABLE BOOK COVER

(75) Inventor: Sharon Kom, 1315 W. Cornelia, Chicago, IL (US) 60657

(73) Assignee: Sharon Kom, Chicago, IL (US)

( * ) Notice: Subject to any disclaimer, the term of this patent is extended or adjusted under 35 U.S.C. 154(b) by 595 days.

(21) Appl. No.: 10/898,620

(22) Filed: Jul. 26, 2004

(65) Prior Publication Data

US 2006/0017277 A1 Jan. 26, 2006

(51) Int. Cl.
*B42D 1/00* (2006.01)

(52) U.S. Cl. ..... 281/29; 281/42

(58) Field of Classification Search ..... 224/153, 224/250, 251; 294/138; 206/232, 472, 450, 206/474; 281/29, 42, 36; 402/8; 248/205.2, 248/693, 505

See application file for complete search history.

(56) References Cited

U.S. PATENT DOCUMENTS

| | | | | | |
|---|---|---|---|---|---|
| 713,176 | A | * | 11/1902 | Lynch et al. | 281/34 |
| 732,524 | A | | 6/1903 | Cushman | |
| 745,251 | A | | 11/1903 | Sleght | |
| 1,037,314 | A | * | 9/1912 | Proudfit, Jr. | 402/8 |
| 1,121,566 | A | * | 12/1914 | McKee | 294/138 |
| 1,136,598 | A | * | 4/1915 | Gould | 294/138 |
| 1,492,677 | A | * | 5/1924 | Dunbar et al. | 150/106 |
| 1,698,391 | A | | 1/1929 | Coleman | |
| 2,053,050 | A | | 9/1936 | Rosenberg | |
| 2,311,153 | A | | 2/1943 | Carlo | |
| 2,784,890 | A | * | 3/1957 | Chisholm | 294/152 |
| 3,297,341 | A | * | 1/1967 | Reed et al. | 281/34 |
| 4,036,417 | A | | 7/1977 | Traphagan | |
| 4,412,692 | A | * | 11/1983 | Williams | 281/34 |
| 4,846,500 | A | | 7/1989 | Klang | |
| 4,958,759 | A | * | 9/1990 | Jarvis | 224/153 |
| 5,013,068 | A | | 5/1991 | Maldonado | |
| 5,056,663 | A | * | 10/1991 | Ostrowski | 206/424 |
| 5,059,149 | A | * | 10/1991 | Stone | 446/73 |
| 5,092,630 | A | | 3/1992 | Ostrowski | |

(Continued)

FOREIGN PATENT DOCUMENTS

| | | | |
|---|---|---|---|
| DE | 625134 | * | 1/1936 |

(Continued)

OTHER PUBLICATIONS definition of connected from www.yahoo.com (Jan. 3, 2008).*

*Primary Examiner*—Derris H Banks
*Assistant Examiner*—Jamila Williams
(74) *Attorney, Agent, or Firm*—Berenato, White & Stavish

(57) ABSTRACT

An adjustable book cover that includes a fabric panel with a hook-and-loop connecter system to maintain the panel in a selected size, and two endless resilient bands that maintain the panel in position on the book. The panel is folded to the correct size to fit the front and back covers of the book. The hook-and-loop connecter system maintains the panel in the corrected size. The panel is then wrapped around the exterior of the book so that the ends of the panels that include the resilient bands are tucked inside the front and back covers of the book. The resilient bands are then looped around the front and back covers of the book so that the panel is maintained in place on the book.

18 Claims, 4 Drawing Sheets

U.S. PATENT DOCUMENTS

| | | | | | |
|---|---|---|---|---|---|
| 5,110,232 | A | * | 5/1992 | Jermann | 402/8 |
| 5,158,325 | A | | 10/1992 | Landis | |
| D334,404 | S | | 3/1993 | Ostrowski | |
| 5,219,437 | A | | 6/1993 | Moor | |
| 5,251,945 | A | * | 10/1993 | Stoops | 294/152 |
| D349,725 | S | * | 8/1994 | Roy | D19/26 |
| 5,352,007 | A | * | 10/1994 | Kirsch | 294/149 |
| 5,409,282 | A | * | 4/1995 | Bale | 294/152 |
| 5,470,109 | A | | 11/1995 | Grande | |
| 5,472,237 | A | | 12/1995 | Rajeswaran | |
| 5,474,332 | A | * | 12/1995 | Yeh | 281/19.1 |
| 5,695,233 | A | * | 12/1997 | Feldman | 294/138 |
| 5,769,477 | A | | 6/1998 | Lehrer | |
| D417,695 | S | * | 12/1999 | Riley | D19/26 |
| 6,186,690 | B1 | * | 2/2001 | Duncan | 402/8 |
| 6,257,622 | B1 | | 7/2001 | Peker | |
| D462,987 | S | * | 9/2002 | Ruscetta et al. | D19/26 |
| 6,641,170 | B2 | | 11/2003 | Yip | |
| 6,749,095 | B2 | * | 6/2004 | Johnson | 224/250 |
| D522,054 | S | * | 5/2006 | Martinez | D19/26 |
| 2003/0234531 | A1 | | 12/2003 | Silverman | |

FOREIGN PATENT DOCUMENTS

| | | | |
|---|---|---|---|
| DK | 33742 | * | 9/1924 |
| FR | 1100367 | * | 9/1955 |
| GB | 178313 | * | 4/1922 |
| JP | 2003JP0277315 | * | 4/2004 |
| JP | 2004098665 A | * | 4/2004 |

* cited by examiner

ADJUSTABLE BOOK COVER AND METHOD OF MAKING AN ADJUSTABLE BOOK COVER

FIELD OF THE INVENTION

The invention generally relates to covers for books and more particularly to adjustable book covers.

DESCRIPTION OF THE BACKGROUND ART

The most common type of adjustable book covers are known as "folded covers". Folded covers are comprised of a flat sheet of material that is folded around a book and tucked into the areas adjacent to the front and back covers of the book. Folded covers are adequate if the book is not handled or used extensively, however, folded covers tend to come off easily with moderate use because their design relies on friction to hold the covers in place. If an adhesive such as tape or glue is used to attach the cover to the book, the adhesive may damage the book and result in permanent tears or discoloration of the book surfaces. If a bookseller or owner customizes the cover by cutting and modifying the cover to specifically fit a particular book, then the cover cannot be re-used on a book of a different size. Additionally, folded covers are generally comprised of paper or thin plastic, and tend to be delicate and incapable of extensive wear.

The prior art also includes book covers comprised of more durable materials such as fabric, leather, vinyl, and heavier gauge plastics. Although these materials wear effectively, the associated size adjustment systems and cover retention mechanisms do not provide a snug and secure fit between the adjustable cover and the book.

The need exists for a durable adjustable book cover that incorporates a size adjustment system that ensures that the adjustable book cover correctly fits a selected book, and a cover retention system that ensures that the cover is retained on the book. The present invention provides an adjustable book cover comprised of a durable fabric that is maintained in the correct size by a hook-and-loop connecter system, and is held in position on the book by at least two resilient straps.

SUMMARY OF THE INVENTION

The invention comprises an adjustable cover for a book. The adjustable book cover is comprised of a panel that at least partially encases the front and back covers of the book. The panel also includes at least two endless resilient bands. When the panel is installed on the book, the endless resilient bands encircle the front and back covers of the book to securely retain the panel on the book.

The invention also includes a cover for a book. The cover is comprised of a panel with a panel size adjustment system on an interior face of the panel. The size adjustment system is comprised of hook-and-loop fasteners that enable the panel top and bottom edges to be folded inwardly so that the panel is adjusted to the correct size to fit a book. The hook-and-loop connecter system maintains the panel in the corrected size. Endless resilient bands are attached to opposite ends of the panel midway between the top and bottom edges of the panel. Once the panel is adjusted to fit the book, the resilient bands encircle the front and back covers of the book so that the panel is maintained in place on the book.

The invention also includes an adjustable book cover comprised of a panel for encasing the front and back covers of a book. The adjustable book cover comprises a first connecter strip covering a first edge of the panel, and a parallel second connecter strip covering the opposite second edge of the panel. A third connecter strip that is parallel with the first and second strips is positioned half way between the first and second strips. The panel also includes at least four connecter patches positioned on each of the four corners of the panel, and one patch positioned at a midpoint between the top two corner patches along the top edge of the panel, and one patch positioned at a midpoint between the bottom two corner patches along the bottom edge. The area covered by the panel is adjusted by folding the top and bottom edges of the panel inwardly so that the connecter patches engage the connecter strips and thereby enable the size of the panel to be adjusted.

The invention also includes a method of making an adjustable book cover. The method includes the steps of providing a panel of foldable material, the panel having an interior side and an exterior side. Attaching a panel size adjustment system of connecter patches and strips to the interior side of the panel. At least two endless resilient bands are then connected to the opposite ends of the panel on the exterior side of the panel. A strip of material extends around the panel exterior side in an oval so that the opposite ends of the oval form two handles and thereby enable a book to be carried by the handles when the adjustable book cover is in place on the book.

The invention further includes a method of installing an adjustable book cover on a book. The method includes providing a panel of foldable material, the panel having a hook-and-loop size adjustment system on one side, and at least two endless resilient bands on the other side of the panel. The two endless resilient bands are attached to opposite ends of the panel. The panel is then folded to a correct size to fit the front and a back cover of a book. The hook-and-loop adjustment system is engaged to maintain the panel in the correct size. The panel is wrapped around the book so that each of the ends of the panel that include the endless resilient bands are tucked between the front and back covers of the book. One of the endless resilient bands is then looped around the front cover of the book and the other endless resilient band is looped around the back cover of the book to ensure that the panel is maintained on the book.

DETAILED DESCRIPTION OF THE PERFERRED EMBODIMENTS

Figure 1:
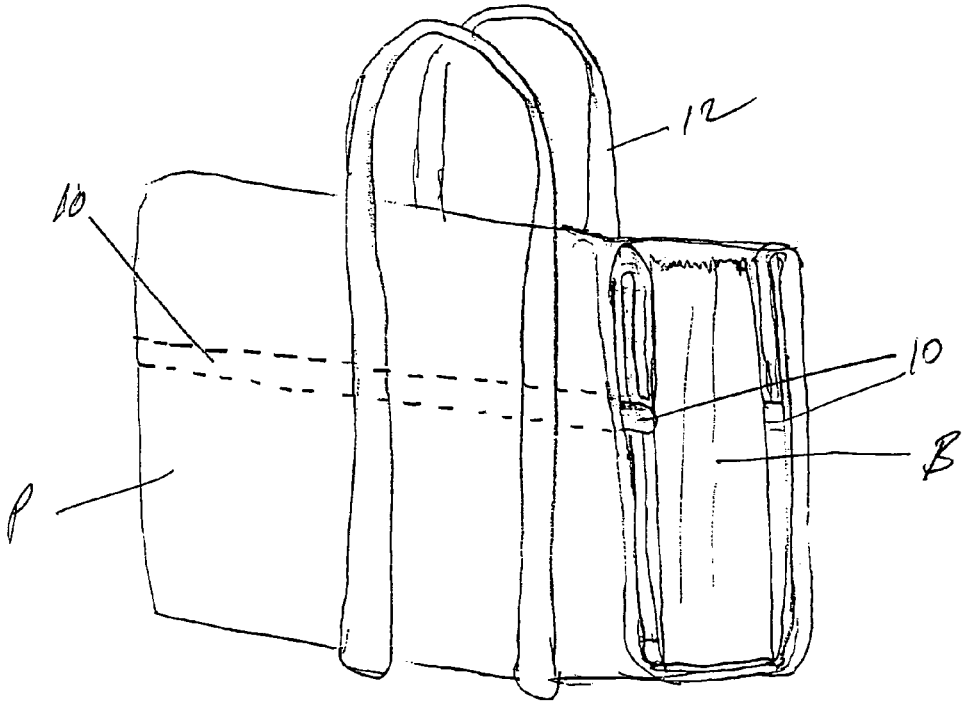
FIG. 1 is a perspective view of the adjustable book cover of the present invention installed on a book.

As best shown in FIG. 1, the current invention is an adjustable book cover that is designed to protect the exterior front and back covers of a book B. The adjustable book cover is comprised of a panel P that is folded into the correct size and then wrapped around the book B. In the preferred embodiment, the panel P is comprised of a cloth fabric. The panel P is held in place by at least two endless resilient bands 10 (shown in dashed and solid lines) connected to each of two opposite ends of the panel P. The adjustable book cover also includes handles 12 that allow the book B to be easily carried.

Figure 2:
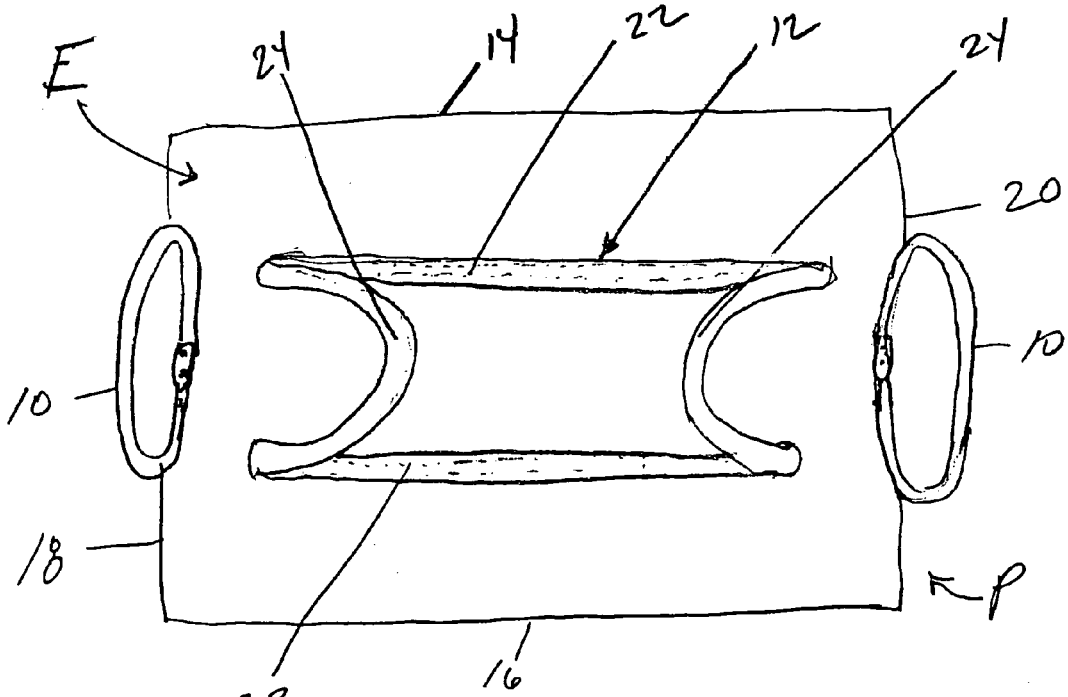
FIG. 2 is a plan view of the exterior side of the present invention.
Figure 3:
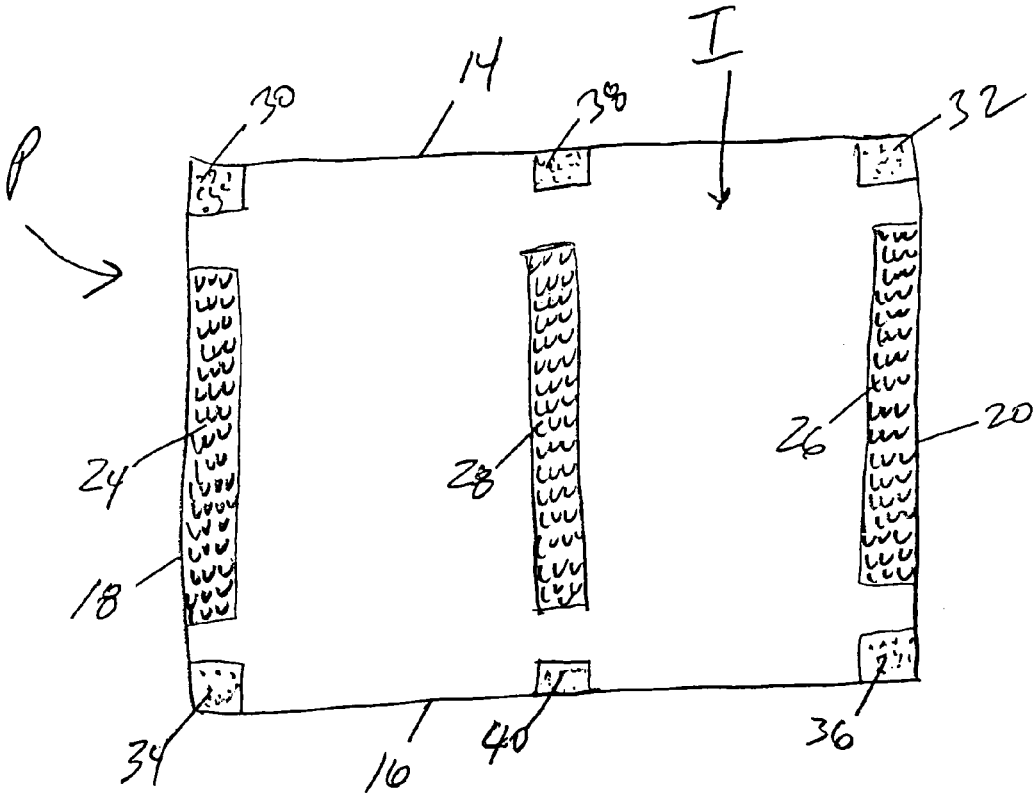
FIG. 3 is a plan view of the interior side of the present invention.

As best shown in FIGS. 2 and 3, the panel P has an interior side I and an exterior side E. The interior side I of the panel P generally faces inwardly toward the book B when the panel P is installed on the book B, and the exterior side E of the panel P generally faces away from the book B when the panel is installed on the book B. The panel P also has a top edge 14 and a bottom edge 16, and a first lateral end 18 and a second lateral end 20, as best shown in FIGS. 2 and 3.

As best shown in FIG. 2, the exterior side E of the panel P includes two endless resilient bands 10 disposed at each lateral end 18, 20 of the panel P. The endless resilient bands 10 are positioned between the top edge 14 and the bottom edge 16. In the preferred embodiment, the endless resilient bands 10 are connected at a midpoint between the top 14 and bottom 16 edges of the panel P.

Figure 6:
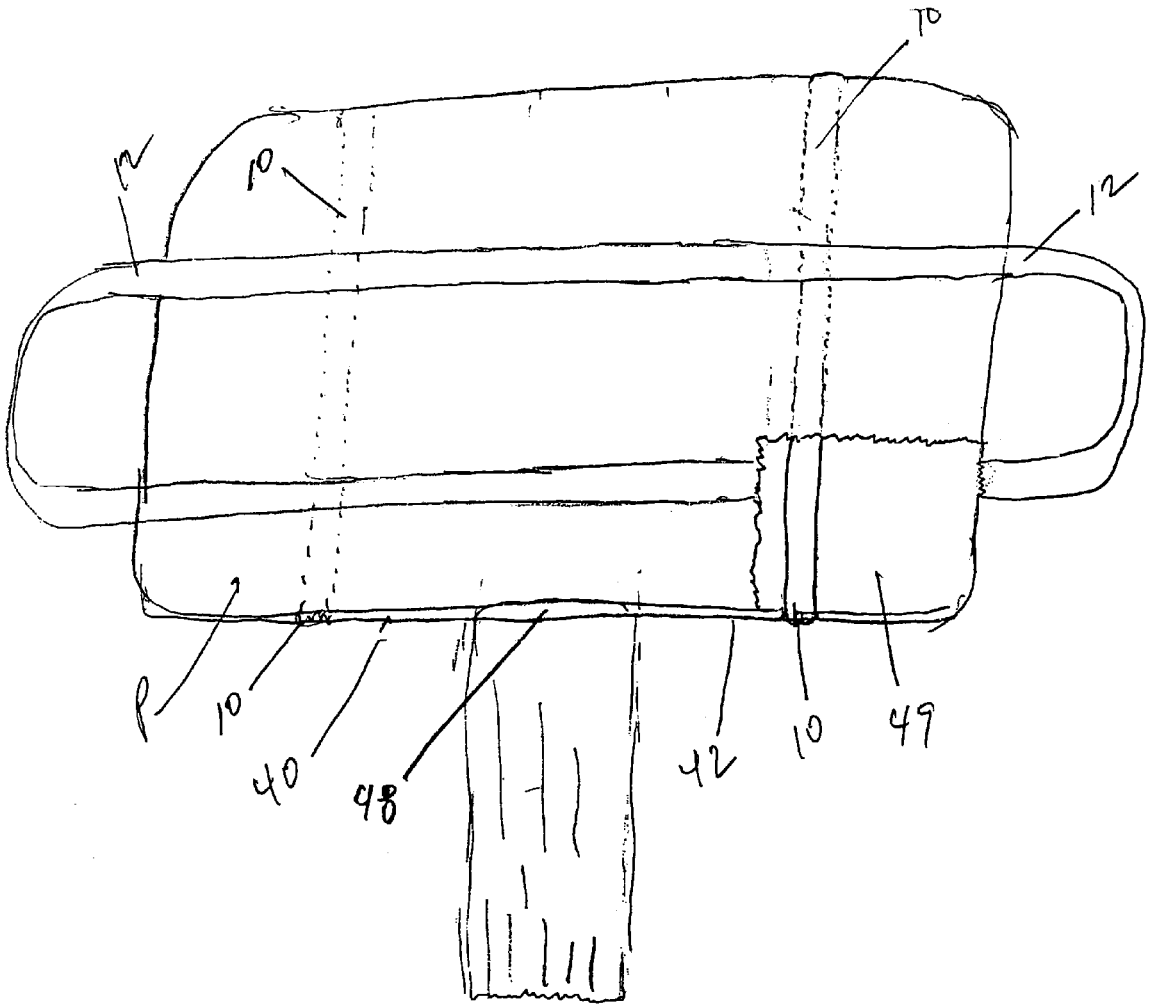
FIG. 6 is a fragmentary perspective view of the present invention installed on a book with the pages of the book extending vertically downward and the front and back covers of the book spread out horizontally.

As best shown in FIGS. 1, 2 and 6, the handles 12 are also positioned on the exterior face E of the panel P. In the preferred embodiment, the handles 12 are comprised of an oval-shaped endless strap with a middle portion 22 of the strap attached to the exterior face E of the panel P, and the rounded end portions 24 of the strap unattached so that the handle 12 may be easily grasped. In FIG. 2 the rounded portions 24 of the handles 12 are folded inwardly. Multiple additional types of handles and handle systems are known in the art and should be considered within the scope of the invention.

As best shown in FIG. 3, a panel size adjustment system is disposed on the panel P interior side I. The panel size adjustment system allows the "height" of the panel to be adjusted. The height of the panel is the vertical distance along the spine of the book when the panel is installed on the book and the book is placed in the normal upright position on a bookshelf. The panel size adjustment system is comprised of a system of connecters that engage one another to allow the height of the panel to be altered.

As best shown in FIG. 3, in the preferred embodiment, the panel size adjustment system is comprised of a first connecter strip 24 covering a first edge 18 of the panel P, and a second connecter strip 26 covering the opposite second edge 20 of the panel P. The same stitching that secures the first 24 and second 26 strips to the interior face I of the panel P may also secure the corresponding resilient bands 10 to the exterior face E of the panel P. A third connecter strip 28 is parallel with the first 24 and second 26 strips and is positioned half way between the first 24 and second 26 strips. The panel also includes at least four connecter patches 30, 32, 34, 36 positioned on each of the four corners of the panel P, and one patch 38 positioned at a midpoint between the top two corner patches 30, 32 along the top edge 14 of the panel, and one patch 40 positioned at a midpoint between the bottom two corner patches 34, 36 along the bottom edge 16 of the panel P.

Figure 4:
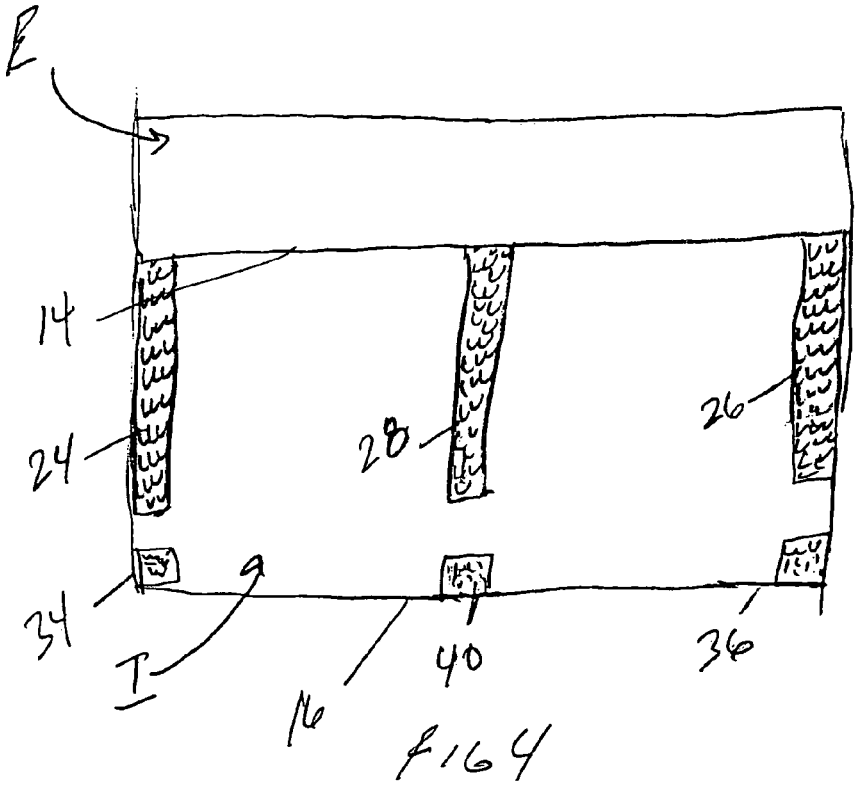
FIG. 4 is a plan view of the invention with the top portion of the panel adjusted and the bottom portion of the panel unadjusted.

As best shown in FIGS. 3 and 4, to adjust the size of the panel P, the top 14 and bottom 16 edges of the panel P are folded inwardly so that the top connecter patches 30, 32, 38 and the bottom connecter patches 34, 36, 40 engage the elongated connecter strips 24, 26, 28. Specifically, the top 30 and bottom 34 corner patches engage the first connecter strip 24; the top 32 and bottom 36 corner patches engage the second connecter strip 26; and the top 38 and bottom 40 patches positioned between the corners engage the third connecter strip 28. FIG. 4 shows a partially adjusted panel P in which the top edge 14 has been folded inwardly to adjust the top portion of the panel P, but the bottom portion of the panel P has not been adjusted.

In the preferred embodiment, the connecters are hook-and-loop connecters, however, various types of connecters and connecting systems should be considered within the scope of the invention. These connecting systems may include, but are not limited to, connecters comprised of adhesives, tapes, snaps, buckles, buttons, clips, tied connections, and the like.

Figure 5:
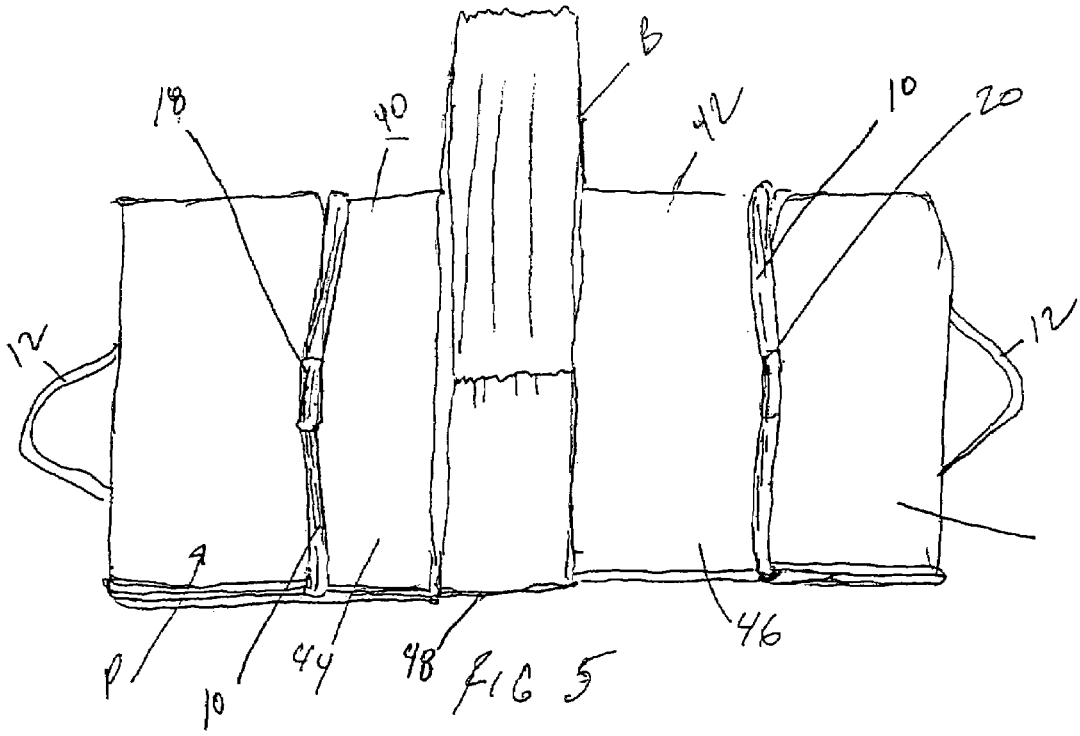
FIG. 5 is a perspective view of the present invention installed on a book with the pages of the book extending vertically upward and the front and back covers of the book spread horizontally.

As best shown in FIG. 5, after the panel P has been adjusted to the appropriate height, the panel P is folded around the front 40 and back 42 covers of the book B so that the panel P encases the book and the first 18 and second 20 lateral ends of the panel P are positioned adjacent to the inside surfaces 44, 46 of the front 16 and back 18 covers of the book B. The "width" of the adjustable book cover is adjusted by pulling the panel P securely around the front 40 and back 42 covers toward the spine 48 of the book B so that the excess portion of the panel P overlaps the inside surfaces 44, 46 of the front 40 and back 42 covers of the book B.

As best shown in FIGS. 5 and 6, the endless resilient bands 10 are looped around the front 40 and back 42 covers of the book B so that the panel P is securely held in position on the book B. As best shown in FIG. 5, the endless resilient bands 10 are attached to a midpoint of the panel P adjacent to each of the first 18 and second lateral 20 ends of the panel P. The resilient bands 10 extend from the panel P attachment point across the inside surfaces 44, 46 of the front 40 and back 42 covers of the book B. As best shown by the solid and dashed lines in FIG. 6, the resilient bands 10 then extend around the outside surface 49 of the front 40 and back 42 covers of the book B between the interior face I of the panel P and the outside surface 49 the book covers 40, 42. FIG. 6 shows a corner portion of the panel P adjacent to the back cover 42 of the book B removed so that the position of the resilient bands 10 are clearly visible. Once in place, the resilient bands 10 grip the front 40 and back 42 covers of the book B and prevent the panel P from sliding off the book B.

For the foregoing reasons it is clear that the preferred embodiment of the current invention comprises an adjustable book cover that incorporates a hook-and-loop panel size adjustment system to ensure that the adjustable cover correctly fits a selected book, and a cover retention system comprised of endless resilient bands that ensures that the cover is securely maintained on the book.

The invention may be modified and applied in various applications. Although some of the materials of construction have been generally described, it should be understood that any materials may be used that are consistent with the function of the invention. For example, the panel P may be comprised of any material capable of being positioned around a book in the manner suggested by the invention. These materials may include, but are not limited to, paper, cardboard, plastic, leather, various fabrics, vinyl, composite materials, and the like. The above flexible materials may also be used in combination with more rigid materials.

Similarly, the endless resilient bands 10 may be comprised of elastic straps, or any resilient material known in the art, including rubber, expandable plastics, synthetic material, and the like. Although two endless resilient bands 10 are shown in the drawings, the use of one or more than two resilient bands 10 should also be considered within the scope of the invention. Although the resilient bands 10 are shown as positioned at the two opposite ends of the panel P, the resilient bands 10 may be positioned anywhere on the panel P, including, but not limited to, the interior side of the panel P and the center of the panel P. The resilient bands 10 may also be considerably wider or narrower than the resilient bands 10 shown in the drawings. Although the bands 10 of the preferred embodiment are resilient, similar configurations of the panel P that include bands 10 that are not resilient should also be considered within the scope of the invention. Such variations are not to be regarded as a departure from the invention and all such modifications as would be obvious to one of ordinary skill in the art are intended to be included in the scope of the following claims.

I claim:

1. An adjustable book cover for covering a book having front and back covers each having inside and outside surfaces, the adjustable book cover comprising:

a panel for covering the book, said panel having an interior face and an exterior face opposite the interior face, a top edge and an opposite bottom edge, and a first lateral edge and an opposite second lateral edge, and said panel for at least partially encasing the front and back covers of the book, at least first and second endless resilient bands attached to said panel, said first endless resilient band attached to said panel on the inside surface of the front cover of the book for encircling the front cover of the book, and said second endless resilient band attached to said panel on the inside surface of the back cover of the book for encircling the back cover of the book and thereby retaining said panel in place on the book, and a panel size adjustment system being disposed on said interior face for adjusting a size of the panel, said panel size adjustment system comprising a first connecter strip extending adjacent to said first lateral edge, a second connector strip extending parallel with said first connecter strip, said second connecter strip extending adjacent to said second lateral edge, and a first, second, third, and fourth connecter patches disposed in each of four corners of said panel, wherein an area covered by said panel is adjusted by folding said top and bottom edges inwardly so that said first through fourth connecter patches engage said first and second connecter strips and thereby enable said panel size to be adjusted to fit the book.

2. The adjustable book cover of claim 1 wherein said first and second endless resilient bands are connected to said panel at opposite ends of said panel.

3. The adjustable book cover of claim 2 wherein said first and second endless resilient bands are connected to said panel intermediate said top edge and said bottom edge.

4. The adjustable book cover of claim 1 wherein each of said first and second endless resilient bands extend between said panel and the outside surface of the front and back covers.

5. The adjustable book cover of claim 1 wherein at least one handle is disposed on said panel so that the book can be carried by said handle.

6. The adjustable book cover of claim 5 wherein said handle is comprised of first and second loops, said first loop extends from said panel exterior face adjacent to the front cover, and, said second loop extends from said panel exterior face adjacent to the back cover.

7. The adjustable book cover of claim 6 wherein said first and second loops are formed from an endless strip of material.

8. The adjustable book cover of claim 1 wherein said endless resilient bands are attached to and extend from said exterior face of said panel.

9. The adjustable book cover of claim 1 wherein said panel size adjustment system is comprised of a system of connectors.

10. The adjustable book cover of claim 1 wherein said connecter strips and patches are comprised of a hook-and-loop fastener material.

11. The adjustable book cover of claim 10 wherein said first connecter strip is disposed directly on an opposite side of said panel from said first endless resilient band, and, said second connecter strip is disposed directly on an opposite side of said panel from said second endless resilient band, wherein said first connecter strip is connected to said panel by a same connecting mechanism that connects said first endless resilient band to said panel, and said second connecter strip is connected to said panel by a same connecting mechanism that connects said second endless resilient band to said panel.

12. An adjustable book cover comprising a panel for encasing a book having front and back covers, said panel having a top edge and an opposite bottom edge, and said panel having a first lateral edge and an opposite second lateral edge, said adjustable book cover further comprising:

a first connecter strip covering a portion of said panel adjacent to said first lateral edge of said panel, a second connecter strip extending parallel with said first connecter strip, said second connecter strip covering a portion of said panel adjacent to said second lateral edge, and at least first, second, third, and fourth connecter patches covering four corners of said panel, wherein an area covered by said panel is adjusted by folding said top and bottom edges of said panel inwardly so that said first through fourth connecter patches engage said first and second connecter strips and thereby enable said panel size to be adjusted to fit the book.

13. The adjustable book cover of claim 12 wherein said connecter strips and patches are comprised of hook-and-loop material.

14. The adjustable book cover of claim 13 wherein said panel has an interior and an exterior face, said connecter strips and patches are disposed on said interior face.

15. The adjustable book cover of claim 14 further comprising a handle system, said handle system being comprised of first and second loops, said first loop extends outwardly from said exterior face of said panel adjacent to said front cover and said second loop extends outwardly from said exterior face of said panel adjacent to said back cover when said adjustable book cover is installed on said book.

16. The adjustable book cover of claim 15 wherein said adjustable book cover further comprises at least first and second essentially circular adjustable straps, said first adjustable strap extending from said first lateral edge, and said second adjustable strap extending from said second lateral edge, wherein one of said adjustable straps encircles said front cover, and another of said adjustable straps encircles said back book cover so that said adjustable book cover is retained on said book.

17. The adjustable book cover of claim 16 wherein said adjustable straps arc attached to said panel on said exterior face of said panel.

18. The adjustable book cover of claim 17 wherein said adjustable straps are comprised of a resilient material.

* * * * *